US005505439A

United States Patent [19]

Watabe et al.

[11] Patent Number: 5,505,439

[45] Date of Patent: Apr. 9, 1996

[54] BILL PROCESSOR

[75] Inventors: Masayuki Watabe, Moroyama; Kenji Nishiumi, Hanno, both of Japan

[73] Assignee: Kabushiki Kaisha Nippon Conlux, Tokyo, Japan

[21] Appl. No.: 233,402

[22] Filed: Apr. 26, 1994

[30] Foreign Application Priority Data

May 11, 1993 [JP] Japan ..... 5-109455

[51] Int. Cl.[6] ..... B65H 29/38

[52] U.S. Cl. ..... 271/177; 271/207

[58] Field of Search ..... 271/162, 163, 271/177–181, 207; 194/206; 221/62, 61, 281; 232/12, 28, 43.2, 43.5

[56] References Cited

U.S. PATENT DOCUMENTS

| | | | |
|---|---|---|---|
| 4,678,072 | 7/1987 | Kobayashi et al. | 194/206 |
| 4,807,736 | 2/1989 | Kondo et al. | 271/181 X |
| 4,809,966 | 3/1989 | Kobayashi et al. | 271/181 |
| 4,880,096 | 11/1989 | Kobayashi et al. | 194/206 |
| 4,887,808 | 12/1989 | Dekker et al. | 271/181 |

FOREIGN PATENT DOCUMENTS

| | | | |
|---|---|---|---|
| 62-150456 | 12/1985 | Japan . | |
| 63-108484 | 5/1988 | Japan . | |
| 346955 | 2/1991 | Japan | 271/181 |
| 5-73752 | 9/1991 | Japan . | |

*Primary Examiner*—David H. Bollinger
*Attorney, Agent, or Firm*—Diller, Ramik & Wight

[57] ABSTRACT

In a bill processor including a main body and a bill stacker arranged on the rear surface side of the main body for storing stacked bills therein, the position of a supporting device for turnably supporting the bill stacker to the main body and the position of a latching device for latching the bill stacker to the main body are changed depending on the "upstack attitude" or the "downstack attitude" of the main body, without changing the position of the bill stacker relative to the main body.

5 Claims, 9 Drawing Sheets

BILL PROCESSOR

BACKGROUND INVENTION

1. Field of the Invention

The present invention relates to a bill processor usable in a money handling apparatus such as an automatic vending machine, a money exchanger, a money service machine or the like, for distinguishing false bills from genuine bills, and then successively storing bills identified as genuine into a bill stacker.

2. Description of the Related Art

Vending machines, money exchangers and money service machines are generally provided with a bill processor which judges the genuineness of an inserted bill and receives and stores only bills which are judged as genuine.

FIG. 8 is a schematic side view of a conventional bill processor 1 which is mounted to a money handling apparatus (not shown).

The bill processor 1 includes a main body 2 having a substantially L-shaped configuration as seen from one side thereof and a front cover 4 disposed at a lower end part of the front side of the main body 2 in which a bill inserting slit 3 is formed.

On the rear side of the main body 2, there is provided a bill stacker 5 for successively receiving a bill identified as genuine among bills inserted into the main body 2 through the bill inserting slit 3.

The bill stacker 5 is turnably supported at a lower part of the main body 2 by means of a shaft 6 while a lever 9 is turnably supported at an upper part of the main body 2 by means of a shaft 8. A pin 7 is fixedly disposed at an upper part 5*a* of the bill stacker 5 in such a position that an end part 9*a* of the lever 9 is turnably brought in engagement with the pin 7. In the normal use of the bill stacker 5, i.e., at the time when the bill stacker 5 successively receives genuine bills, the bill stacker 5 is latched to the main body 2 by engaging the end part 9*a* of the lever 9 with the pin 7.

A coil spring 10 is provided at another end part of the lever 9 to bias the lever 9 in the clockwise direction as viewed in the drawing, and a cover 11 is provided over an upper surface 5*b* of the bill stacker 5 to close the upper surface 5*b* when the bill stacker 5 is latched to the main body 2.

When a predetermined number of bills are stacked in the bill stacker 5, the stacked bills must be taken out from the bill stacker 5, which is usually done by bill collecting persons.

In the bill collecting operation, a bill collecting person first turns the lever 9 in the anti-clockwise direction about the shaft 8 so as to release the bill stacker 5 from the engaged state to the main body 2.

Subsequently, the collecting person turns the bill stacker in the clockwise direction to a position as shown by a phantom line, whereby the upper surface 5*b* of the bill stacker 5 is uncovered and opened to the outside. Thus, the stacked bills 12 can be taken out from the bill stacker 5 through the upper surface 5*b* in the upward direction.

In FIG. 8, the bill processor 1 takes an attitude (upstack attitude) in which it is mounted to a money handling apparatus with the bill inserting slit 3 being positioned at the lower end part of the main body 2. In the "upstack attitude", a bill inserted into the main body 2 through the bill inserting slit 3 and is judged genuine is conveyed upward up so as to be stored in the bill stacker 5.

The bill processor 1 may take another attitude (downstack attitude) in which it is turned upside down from the "upstack attitude" so that the bill inserting slit 3 is positioned at the upper end part of the main body 2 as shown in FIG. 9. In the "downstack attitude", a bill inserted into the main body 2 through the bill inserting slit 3 and judged genuine is conveyed downward so as to be stored in the bill stacker 5.

FIG. 9 illustrates the conventional bill processor arranged in the "downstack attitude " in which the bill inserting slit 3 is located at the upper part of the main body 2 and the shaft 6 for turnably supporting the bill stacker 5 is located at the upper part of the main body 2. In the "downstack attitude", to take out the bills stacked in the bill stacker 5, the lever 9 is turned in the clockwise direction about the shaft 8, causing the bill stacker 5 to be released from the engaged state to the main body 2. Subsequently, the bill stacker 5 is turned in the anti-clockwise direction about the shaft 6 to a position as shown by phantom lines in FIG. 9, whereby the lower surface of the bill stacker 5 (i.e., the upper surface 5*b* of the bill stacker 5 shown in FIG. 8) is uncovered and open to the outside, causing the stacked bills 12 to be taken out of the bill stacker 5 through the lower surface of the bill stacker 5 in the downward direction as shown in the drawing.

With the conventional bill processor 1 constructed in the above-described manner, in the case that the bill processor 1 is mounted to a money handling apparatus in an attitude that the bill inserting slit 3 is located at the upper part of the main body 2 as shown in FIG. 9, i.e., in the "downstack attitude", the stacked bill 12 is taken out from the bill stacker 5 in the downward direction while the lower surface of the bill stacker 5 is kept open to the outside. However, there arises a problem that the stacked bills 12 cannot smoothly collected from the bill stacker 5 because they fall down by their own gravity force immediately after the lower surface of the bill stacker 5 is opened.

To cope with the foregoing problem, a proposal has been made as disclosed in an official gazette of Japanese Laid-Open Utility Model Publication No. 62-150456 in which the upper surface of the bill stacker is always opened both in the "upstack attitude" and the "downstack attitude" of the bill processor. However, with the conventional bill processor as disclosed in the official gazette, there arises another problem that when the bill stacker is mounted to the main body of the bill processor by changing the attitude, it is also necessary to changing the up-down position of the bill stacker with respect to the main body having a bill inserting slit, which is complicated and troublesome.

SUMMARY OF THE INVENTION

The present invention has been made under the aforementioned background and an object of the present invention is to provide a bill processor which assures that bills stacked in the bill stacker can always be taken out from the upside of the bill stacker irrespective of the "upstack attitude" or the "downstack attitude" of the bill processor, without any necessity for changing the position of the bill stacker with respect to the main body of the bill processor.

To accomplish the above object, the present invention provides a bill processor comprising a main body having a bill inserting slit; bill conveying means for conveying bills inserted through the bill inserting slit; a bill stacker arranged on the rear surface side of the main body, for successively stacking therein the bills conveyed by the bill conveying means; supporting means for turnably supporting the bill stacker to the main body; and latching means for latching the bill stacker to the main body, wherein positions of the supporting means and the latching means are changed corresponding to an "upstack attitude" or a "downstack attitude" assumed by the main body, without any necessity for changing the position of the bill stacker relative to the main body.

To mount the bill processor of the present invention to a money handling apparatus in the "upstack attitude", the supporting means for turnably supporting the bill stacker to the main body is disposed at a lower part of the main body and the bill stacker while the latching means for latching the bill stacker to the main body is disposed at an upper part of the main body and the bill stacker so that the upside of the bill stacker is open to the outside when the bill stacker is released from the latched state. Thus, stacked bills can be collected from the bill stacker through the upper side of the bill stacker.

According to the present invention, to change the bill processor mounted to the money handling apparatus in the "upstack attitude" to the "downstack attitude", it is unnecessary to change the position of the bill stacker relative to the main body. It is only necessary to move the supporting means for rotatably supporting the bill stacker to the main body to a lower side of the main body and the bill stacker, to move the latching means for latching the bill stacker to the main body an upper side of the main body and the bill stacker, and then to move the bill processor upside down so that the upside of the bill stacker is open to the outside when the bill stacker is released from the latched state. Thus, stacked bills can be collected from the bill stacker through the upper side of the bill stacker.

Other objects features and advantages of the present invention will become apparent from reading of the following description which has been made in conjunction with the accompanying drawings.

DESCRIPTION OF THE PREFERRED EMBODIMENT

The present invention will now be described with reference to the accompanying drawings which illustrate a preferred embodiment thereof.

Figure 1:
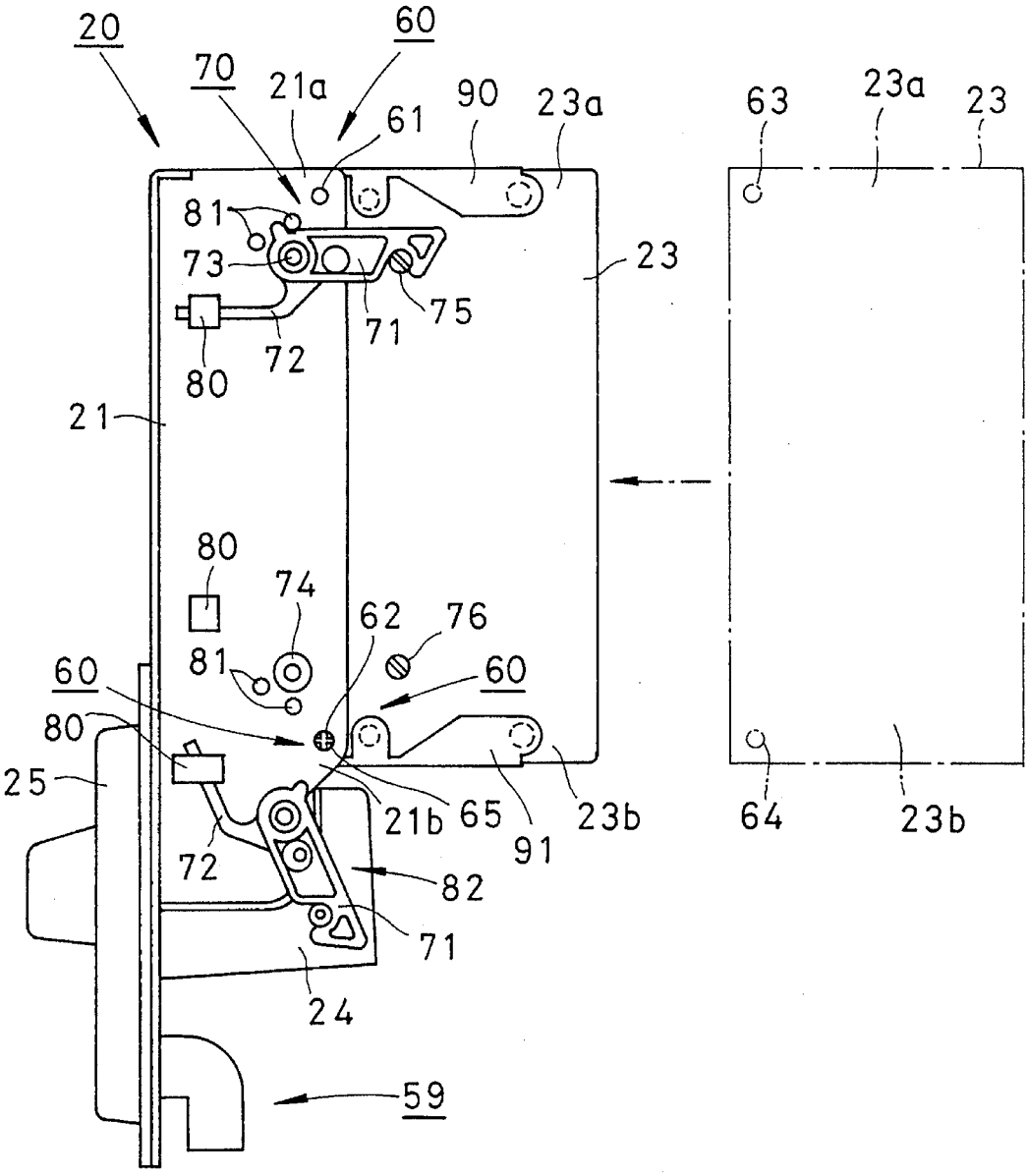
FIG. 1 is a schematic side view of a bill processor constructed according to an embodiment of the present invention wherein the bill processor is mounted to a money handling apparatus (not shown) in the "upstack attitude"

Referring to FIG. 1, a bill processor 20 is mounted to a money handling apparatus (not shown) such as an automatic vending machine or the like. The bill processor 20 is constructed in a substantially inverted L-shaped configuration as viewed from one side thereof and includes as essential components a main body 21 having a motor, a driving mechanism and associated components accommodated therein, a box-shaped bill stacker 23 disposed on the rear surface side of the main body 21, a chute section 24 disposed under the main body 21, and a front cover 25 secured to a front lower side of the main body 21. A bill inserting slit 26 is formed in the front cover 25.

Figure 2:
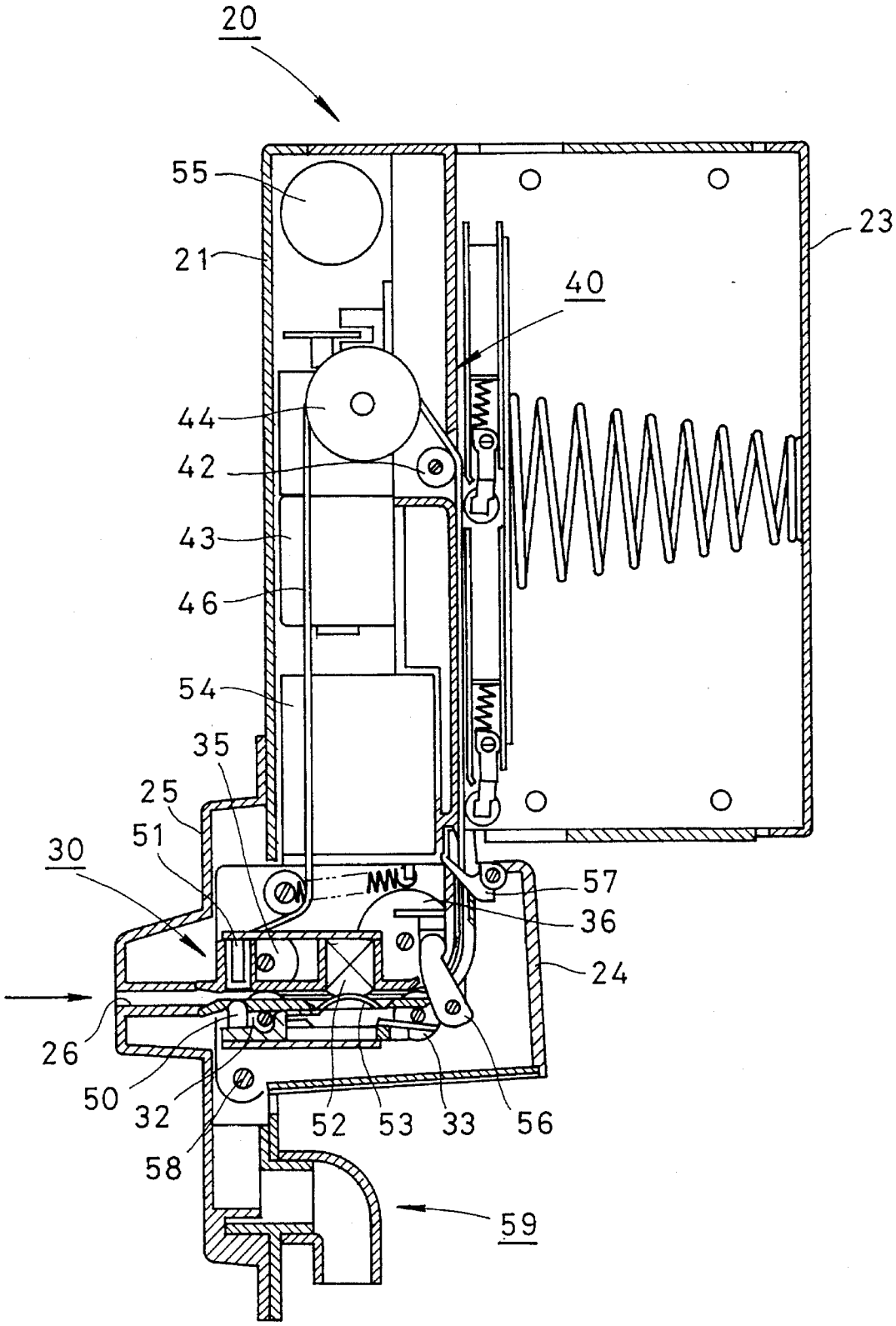
FIG. 2 is a vertical sectional view of the bill processor shown in FIG. 1.

Referring to FIG. 2, the main body 21 accommodates a first bill conveying path 30 for horizontally conveying the bill inserted through the bill inserting slit 26 in the arrow-marked direction, i.e., in the rightward direction as seen in the drawing and a second bill conveying path 40 for vertically conveying the bill conveyed from the first bill conveying path 30 in the upward direction.

The first bill conveying path 30 includes rollers 32 and 33 disposed in the chute section 24, and pulleys 35 and 36 disposed in the main body 21 at the positions opposite to the rollers 32 and 33. The second bill conveying path 40 is operatively associated with the pulley 36 constituting a part of the first bill conveying path 30, and includes a pulley 42 rotatably disposed at an upper part of the main body A bill conveying unit for conveying each bill along the first bill conveying path 30 and the second bill conveying path 40 essentially consists of a conveying belt 46 extending around follower pulleys 35, 36 and 42 and a driving pulley 44 which is driven by a motor 43 disposed in the main body 21. When the driving pulley 44 is driven by the motor 43 in the anti-clockwise direction, a bill inserted through the bill inserting slit 26 is upwardly conveyed to reach a bill stacker 23 via the first bill conveying path 30 and the second bill conveying path 40, and thereafter, the bill is stacked in the bill stacker 23 with the aid of a stacking mechanism (not shown).

In FIG. 2, reference numerals 50 and 51 designate a pair of bill detecting sensors including a light beam emitting element and a light beam receiving element, for detecting whether a bill is inserted through the bill inserting slit 26, reference numeral 52 designates a magnetic sensor for judging each inserted bill as a genuine bill or a false bill, reference numeral 53 designates a leaf spring for bringing the inserted bill in pressure contact with the magnetic sensor 52, reference numeral 54 designates a transformer for feeding electricity to each driving unit, reference numeral 55 designates a motor for driving the stacking mechanism (not shown), reference numeral 56 designates a chute lever for detecting whether the inserted bill is properly conveyed along the first bill path 30 or not, reference numeral 57 designates a drawing-out preventing lever for preventing the inserted bill from being drawn out of the bill processor 20, reference numeral 58 designates a shaft for turnably supporting the chute section 24, and reference numeral 59 designates a liquid collecting/draining portion for collecting the liquid flowing in the interior of the main body 21 through the bill inserting slit 26 and then draining it to the outside.

A bill inserted through the bill inserting slit 26 is detected by the bill detecting sensors 50 and 51 disposed directly behind the bill inserting slit 26, and in response to a detecting signal outputted from the detecting sensor 51, the motor 43 is operated so as to rotate the driving pulley 44 in the normal direction, i.e., in the anti-clockwise direction.

As the driving pulley 44 is rotated in the normal direction, the inserted bill is horizontally conveyed along the first bill conveying path 30 by the conveying force given by the endless conveying belt 46 in the rightward direction as seen in FIG. 2 while it is being clamped between the roller 32 and the conveying belt 46.

As the bill is horizontally conveyed along the first bill conveying path 30 in the rightward direction, a genuine/false bill judging section including the magnetic sensor 52 disposed at the substantially intermediate position of the first bill conveying path 30 determines whether the inserted bill is a genuine bill or a false bill.

When the inserted bill is determined as a false bill by the genuine/false bill judging section, the driving pulley 44 is rotated in the reverse direction, i.e., in the clockwise direction as the motor 43 is operated in the reverse direction, causing the inserted bill to be returned to a user via the bill inserting slit 26.

When the inserted bill is determined as a genuine bill, the motor 43 continues to be operated in the normal direction in conformity with the detection signal outputted from the magnetic sensor 52, and subsequently, the bill is vertically conveyed along the second bill conveying path 40 in the upward direction by the driving force given by the conveying belt 46. Thereafter, the motor 55 for driving the stacking mechanism (not shown) is operated so that bills are successively stacked in the bill stacker 23 with the aid of the stacking mechanism.

As shown in FIG. 1, the supporting units 60 for turnably supporting the bill stacker 23 and latching units 70 for latching the bill stacker 23 to the main body 21 are disposed on the opposite side surfaces of the bill processor 20.

Each of the supporting units 60 includes bearing holes 61 and 62 formed at an upper part 21*a* and a lower part 21*b* of the main body 21, bearing holes 63 and 64 formed at an upper part 23*a* and a lower part 23*b* of the bill stacker 23 at the positions corresponding to the bearing holes 61 and 62, and shafts (screws) 65 each serving as a supporting shaft which can be inserted into either of the bearing holes.

Each of the latching units 70 includes a latch member 71 and a spring member 72 in the form of a leaf spring for normally biasing the latch member 71 in a predetermined direction i.e., in the clockwise direction in the shown case. The spring member 72 and the latch member 71 are integrally molded of an elastic material such as a synthetic resin or the like.

Shafts 73 and 74 for turnably supporting the latch member 71 of each latching unit 70 are projected from the upper part 21*a* and the lower part 21*b* of the main body 21, and engagement pins 75 and 76 adapted to be engaged with the foremost ends of the latch members 71 are fixedly fitted to the upper part 23*a* and the lower part 23b of the bill stacker 23 at the positions opposite to the shafts 73 and 74. In FIG. 1, reference numeral 80 designates a supporting member having a substantially U-shaped sectional contour for slidably supporting the spring member 72, and reference numeral 81 designates a pair of stoppers projected from the main body 21 to be engaged with the latch member 71 to restricting the turning movement of the latch member 71 in excess of a predetermined angle. In addition, a latching unit 82 having the same structure as that of the latching unit 70 is disposed between the chute section 24 and the lower end part of the main body 21.

The operation of the bill processor 20 as well as a structure thereof will now be described.

Figure 3:
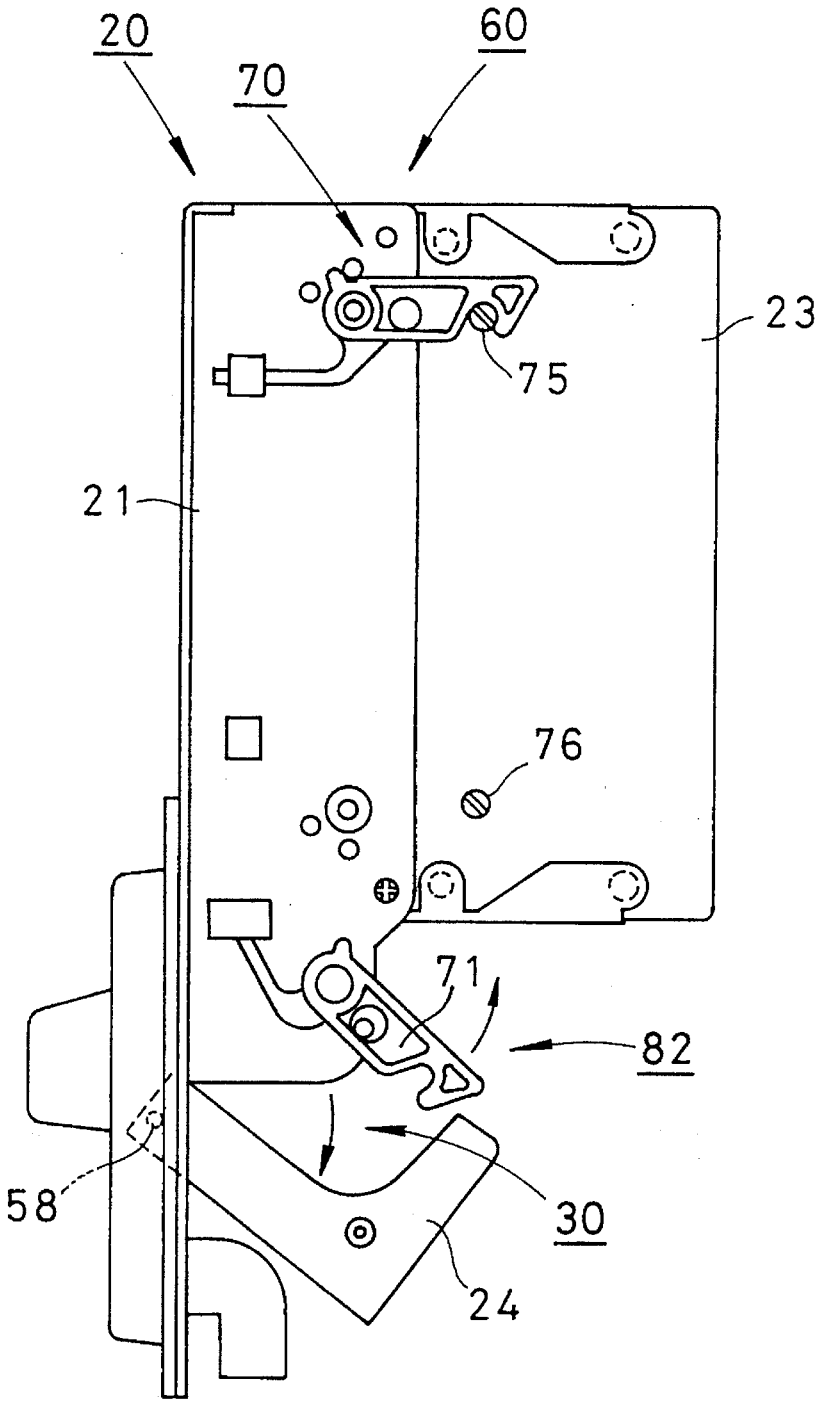
FIG. 3 is a schematic side view of the bill processor, particularly showing an operative state in which a chute section is opened.

FIG. 1 shows the bill processor 20 which is mounted to a money handling apparatus in the "upstack attitude". Referring to FIG. 3, when the latch member 71 of the latching unit 82 is turned in the arrow-marked direction, i.e., in the anti-clockwise direction, the chute section 24 is disengaged from the lower end of the main body 21. Subsequently, when the chute section 24 is turned about a shaft 58 in the clockwise direction, the first bill conveying path 30 is kept open to the outside. This makes it possible to easily perform maintenance and inspecting operations for various kinds of sensors, especially, the magnetic sensor 52 disposed on the first bill conveying path 30 as shown in FIG. 2.

Figure 4:
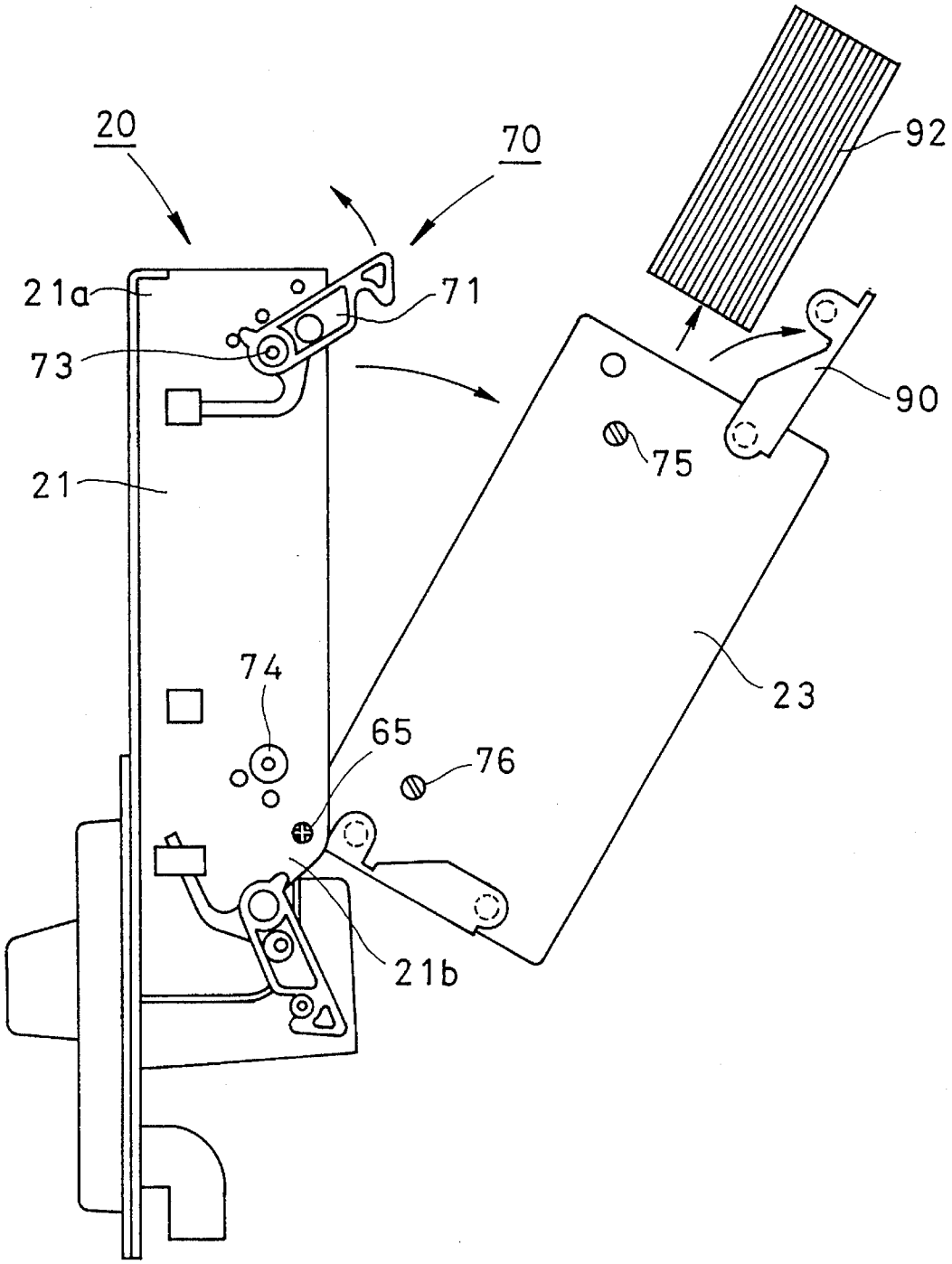
FIG. 4 is a schematic side view of the bill processor, particularly showing that stacked bills is taken out from the bill processor mounted to the money handling apparatus in the "upstack attitude"

Referring to FIG. 4, in collecting the bills stacked in the bill stacker 23 in the "upstack attitude" as shown in FIG. 1, a money collecting person turns the latch member 71 of the latching unit 70 disposed at the upper part 21*a* of the main body 21 about the shaft 73 in the anti-clockwise direction, causing the bill stacker 23 to be disengaged from the main body 1. Subsequently, the bill stacker 23 is turned about the shaft 65 disposed at the lower part 21*b* of the main body 21 in the clockwise direction so that the upper surface of the bill stacker 23 is kept open to the outside. Then, the money collecting person uncovers a cover 90 from the upper surface of the bill stacker 23. Thus, stacked bills 92 can easily be taken out from the bill stacker 23 in the arrow-marked direction for the purpose of collecting.

To change the mounting state of the bill processor 20 to the money handling apparatus from the "upstack attitude" to the "downstack attitude", first, the shaft 65 disposed at the lower part 21*b* of the main body 21 is pulled out from the bearing hole 64 and in turn inserted into the bearing hole 61 formed at the upper part 21*a* of the main body 21 and the bearing hole 63 formed at the upper part 23*a* of the bill stacker 23. At this time, it is unnecessary to change the position of the bill stacker 23 secured to the main body 21 upside down.

In other words, the position of the supporting unit 60 for turnably supporting the bill stacker 23 to the main body 21 is changed according to the attitude change of the main body 21 from the "upstack attitude" to the "downward attitude".

Next, the latch member 71 of the latching unit 70 is removed from the shaft 73 and the supporting member 80 disposed at the upper part 21*a* of the apparatus main body 21 and in turn fitted onto the shaft 74 and the supporting member 80 disposed at the lower part 21*b* of the main body 21.

In other words, the position of the latching unit 70 for latching the bill stacker 23 to the main body 21 is changed according to the attitude change of the main body 21 from the "upstack attitude" to the "downstack attitude".

Figure 5:
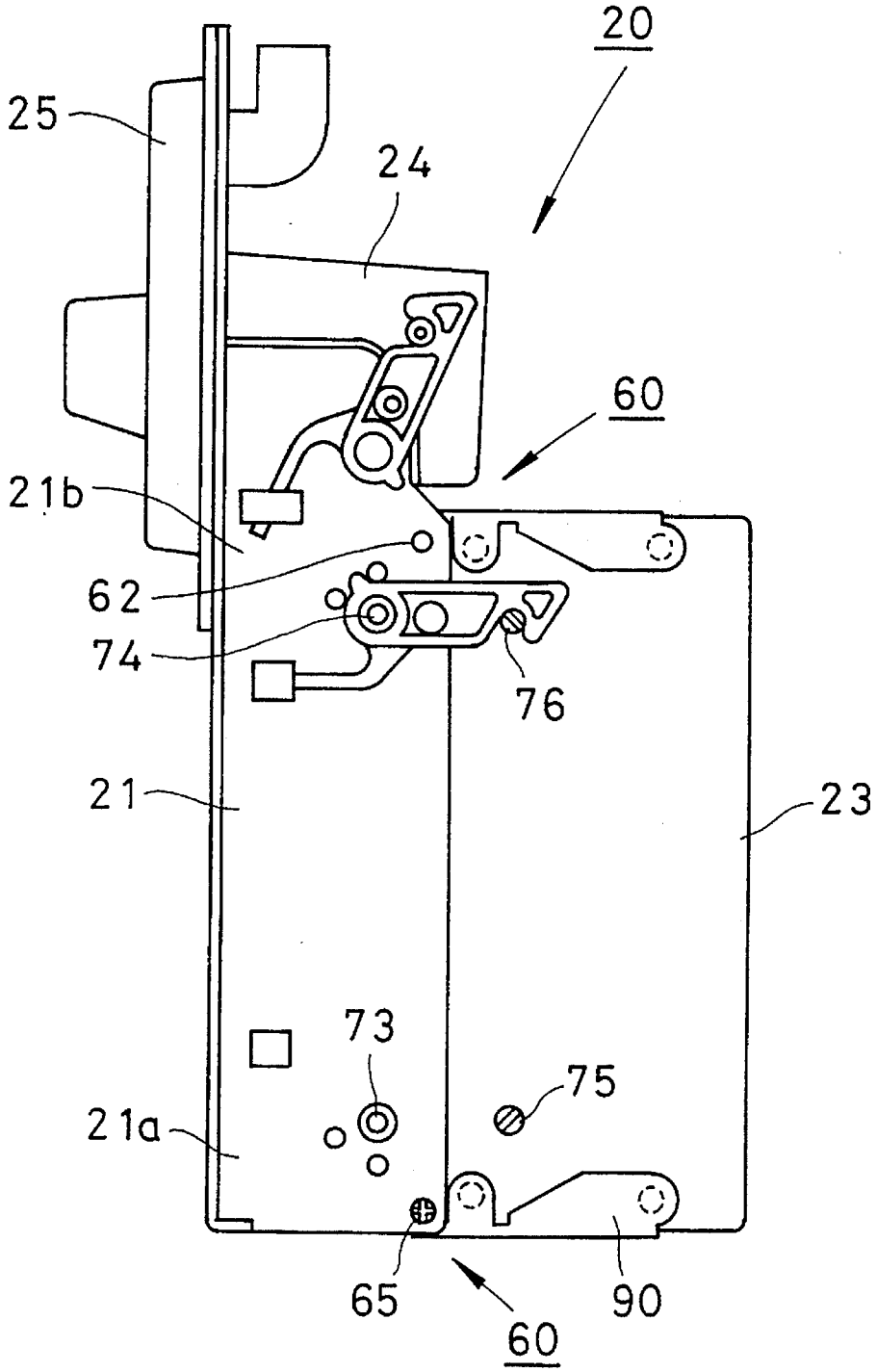
FIG. 5 is a schematic side view of a bill processor constructed according to the embodiment of the present invention wherein the bill processor is mounted to the money handling apparatus in the "downstack attitude"

Then, the bill processor 20 is mounted to the money handling apparatus while the main body is turned upside down as shown in FIG. 5, resulting in that the bill processor 20 is mounted to the money handling apparatus in the "downstack attitude". In FIG. 5, since the upper part 21*a* of the main body 21 becomes a lower part and the lower part 21*b* of the main body 21 becomes an upper part, reference numeral 21*a* designates a lower part of the main body 21 and reference numeral 21*b* designates an upper part of the main body 21.

Figure 6:
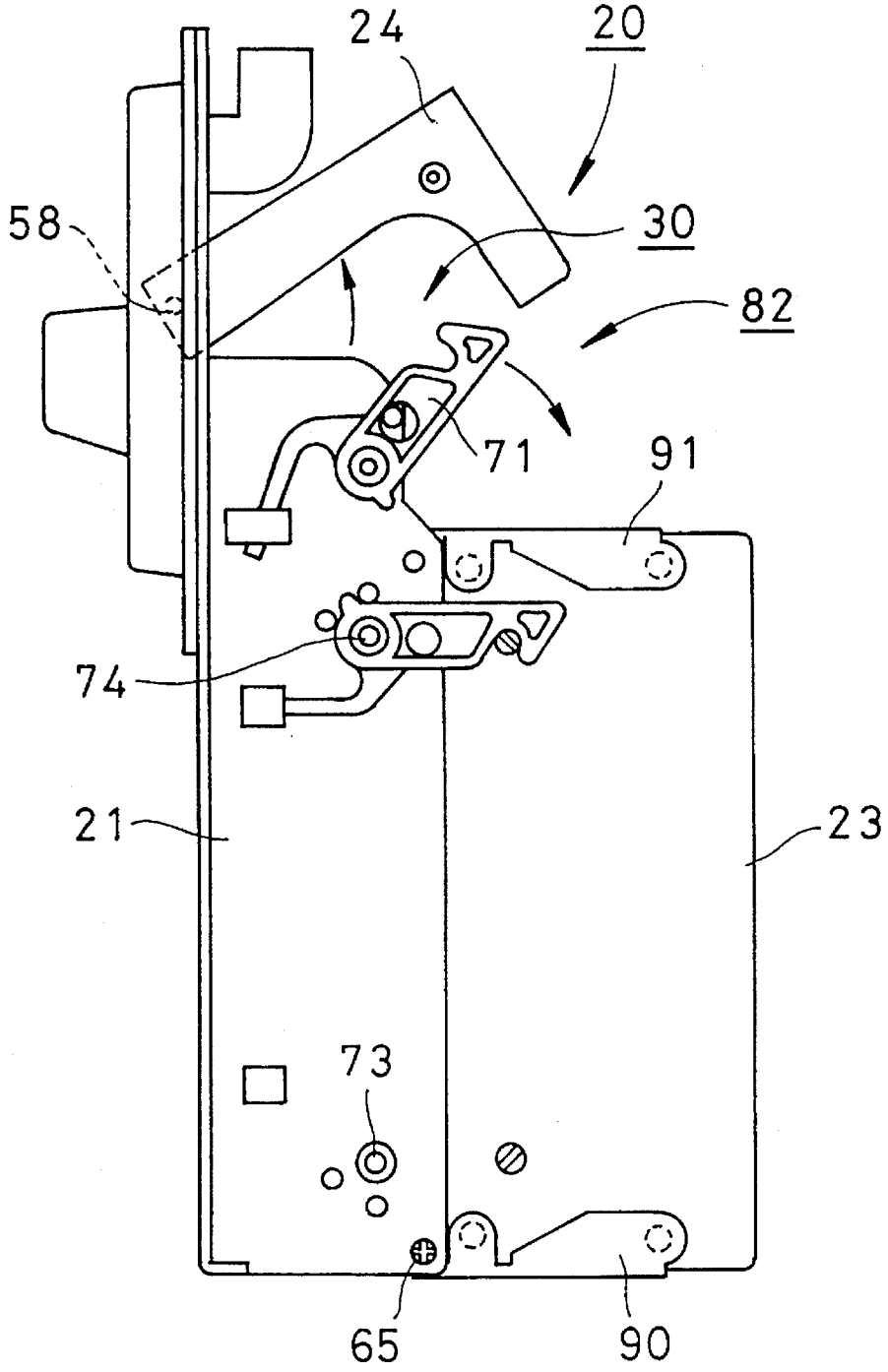
FIG. 6 is a schematic side view of the bill processor shown in FIG. 5, particularly showing an operative state in which a chute section is opened.
Figure 7:
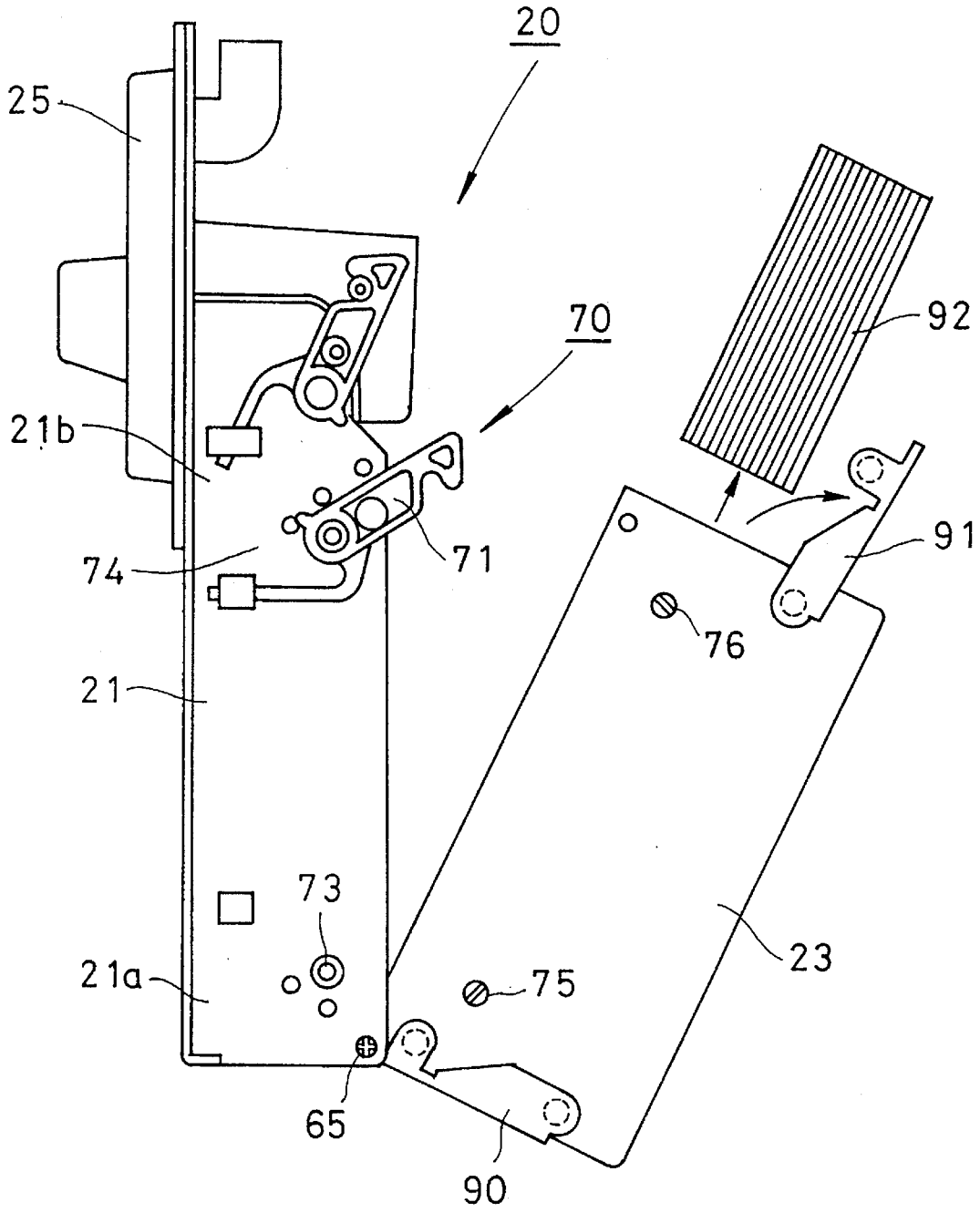
FIG. 7 is a schematic side view of the bill processor, particularly showing that stacked bills is taken out from the bill processor in the "downstack attitude"
Figure 8:
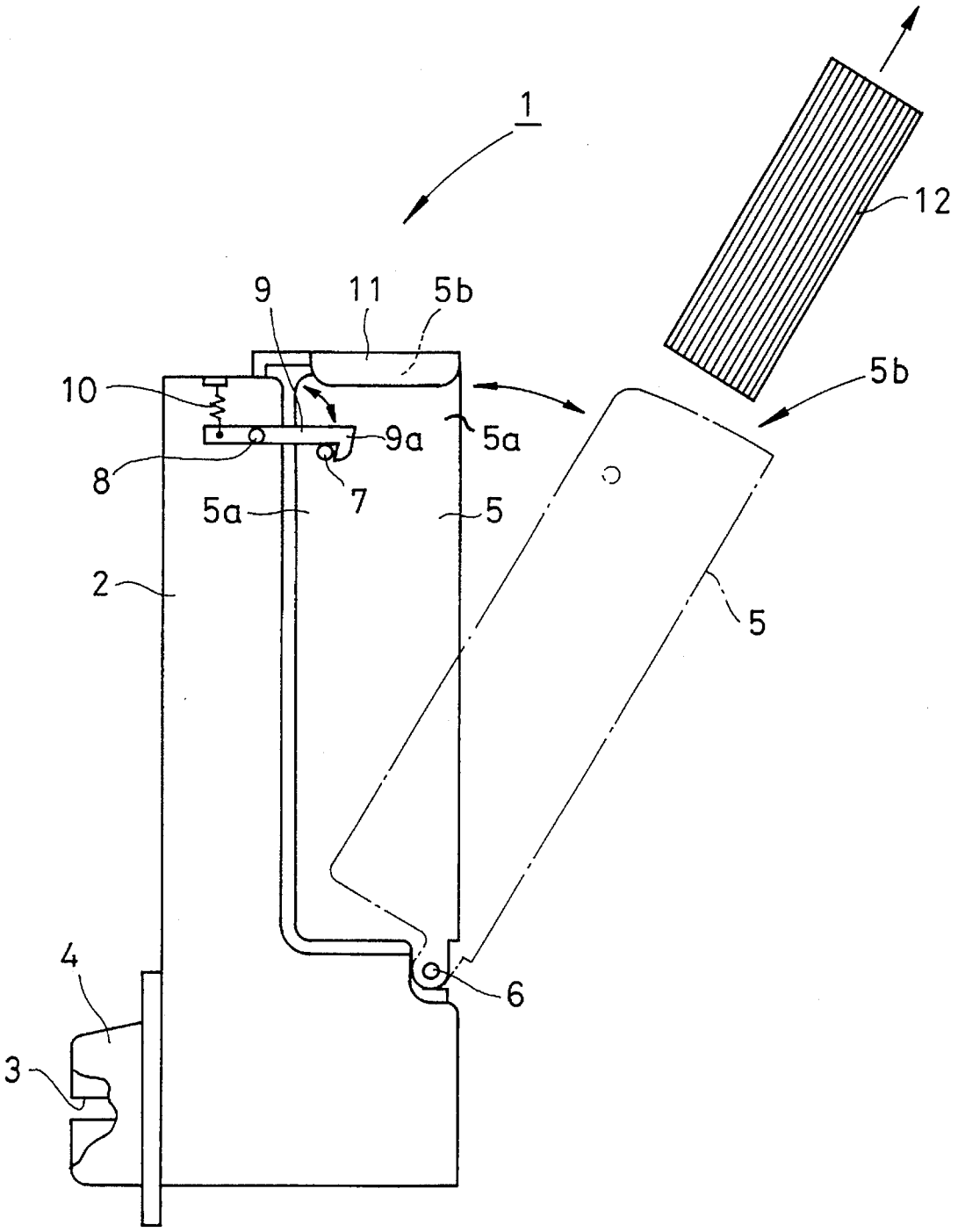
FIG. 8 (PRIOR ART)
FIG. 8 is a schematic side view of a conventional bill processor which is mounted to a money handling apparatus (not shown) in the "upstack attitude"
Figure 9:
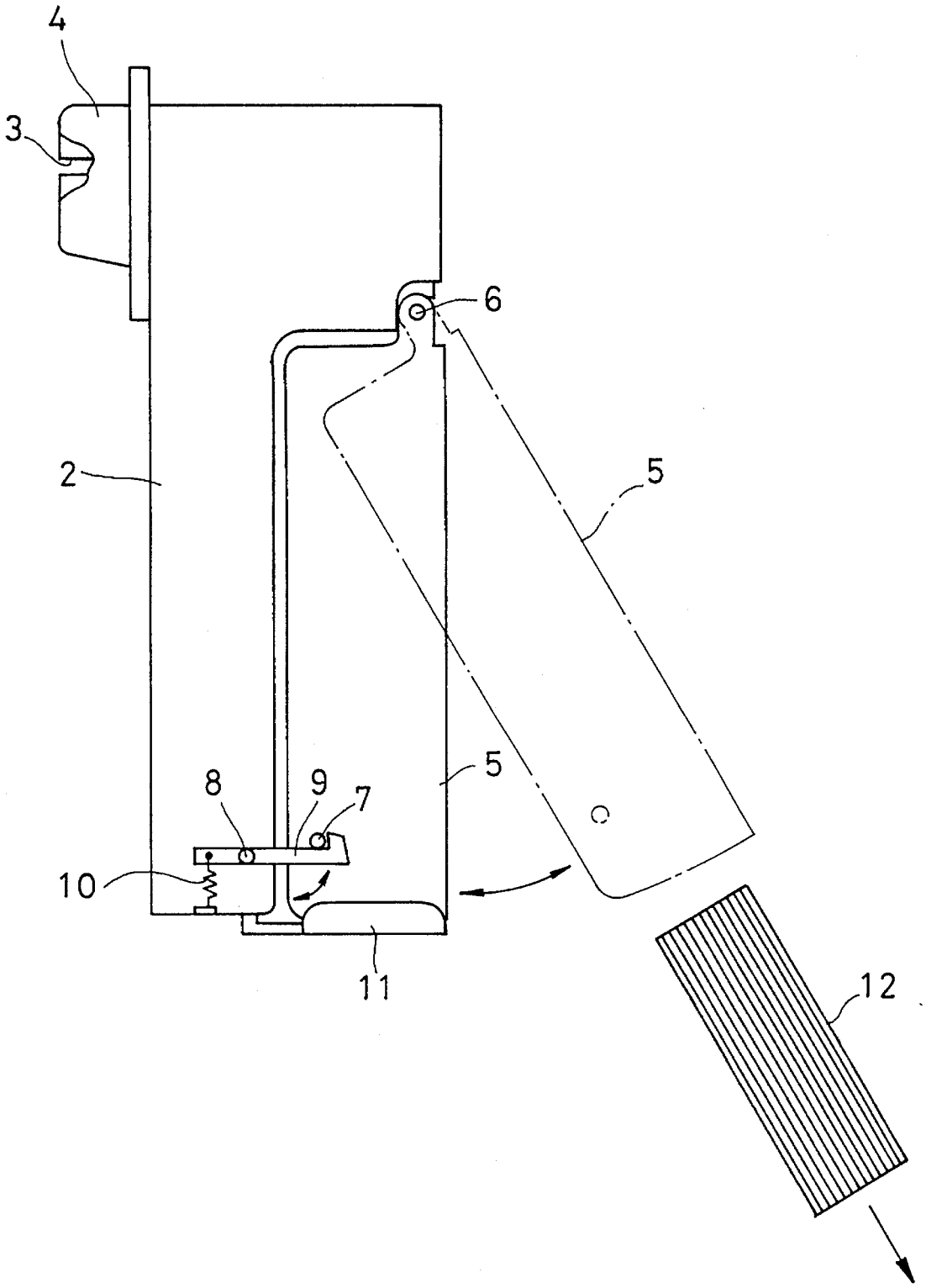
FIG. 9 (PRIOR ART)
FIG. 9 is a schematic side view of the conventional bill processor mounted to the money handling apparatus in the "downstack attitude".

In the case that the bill processor 20 is mounted to the money handling apparatus in the "downstack attitude" as show in FIG. 5, when the latch member 71 of the latching unit 82 for supporting the chute section 24 is turned in the clockwise direction as shown in FIG. 6, the chute section 24 is disengaged from the main body 21. Subsequently, when the chute section 24 is turned about a shaft 58 in the anti-clockwise direction, the first bill conveying path 30 is kept open to the outside. This makes it possible to easily perform maintenance and inspecting operations for various kinds of sensors, especially, the magnetic sensor 52 disposed on the first bill conveying path 30 shown in FIG. 2.

In collecting the bills stacked in the bill stacker 23 in the "downstack attitude" as shown in FIG. 5 from the bill stacker 23, a money collecting person turns the latch member 71 of the latching unit 70 disposed at the upper part 21*b* of the main body 21 about the shaft 74 in the anti-clockwise direction, causing the bill stacker 23 to be released from the main body 21. Subsequently, the bill stacker 23 is turned about the shaft 65 disposed at the lower part 21*a* of the main body 21 in the clockwise direction to open the upper surface of the bill stacker 23 to the outside. Thereafter, the money collecting person uncovers a cover 91 from the upper surface of the bill stacker 23 so that the stacked bills 92 can easily be taken out from the bill stacker 23 through the upper surface.

As described above, according to the present invention, the bill processor assures that the bills stacked in the bill stacker can always be taken out through the upper surface of the bill stacker irrespective of the "upstack attitude" or the "downstack attitude" of the main body. In changing the attitude of the main body of the bill processor, it is unnecessary to change the up-down position of the bill stacker relative to the main body. By merely changing the position of the supporting unit for supporting the bill stacker to the main body and the position of the latching unit for latching the bill stacker to the main body, and by turning the bill processor is upside down, the stack attitude can be changed between the "upstack attitude" and the "downstack attitude". Consequently, stacked bills can be collected from the bill stacker always through upper portion thereof regardless of the "upstack attitude" or the "downstack attitude".

While the present invention has been described above with respect to a single preferred embodiment thereof, it should of course be understood that the present invention should not be limited only to this embodiment but various change or modification may be made without departure from the spirit and the scope of the present invention. For this reason, the aforementioned embodiment is merely illustrative in respect of all viewpoints and it should not be construed that it is limitative. In addition, the scope of the present invention is defined only by the claim clause, and therefore, it is not restricted by the content of this specification. Further, any type of change or modification made in that way falls under the scope of the present invention.

What is claimed is:

1. A bill processor comprising:

a main body having a bill inserting slit;

bill conveying means for conveying bills inserted through the bill inserting slit;

a bill stacker provided on a rear side of the main body, for successively stacking therein the bills conveyed by the bill conveying means;

supporting means for turnably supporting the bill stacker relative to the main body; and latching means for latching the bill stacker to the main body, wherein positions of the supporting means and the latching means are changeable corresponding to an "upstack attitude" in which the bill inserting slit is positioned at a lower end part of the main body or a "downstack attitude" in which the bill inserting slit is positioned at an upper end part of the main body such that the supporting means is always positioned below the latching means, without changing the position of the bill stacker relative to the main body.

2. The bill processor as claimed in claim 1, wherein the supporting means includes:

first bearing holes formed at an upper part and a lower part of the main body;

second bearing holes formed in the bill stacker at positions corresponding to positions of the first bearing holes in the main body; and a shaft adapted to be inserted into one of the first bearing holes and one of the second bearing holes corresponding to said one of the first bearing holes.

3. The bill processor as claimed in claim 1, wherein the latching means includes:

a pair of shafts fixedly disposed at an upper part and a lower part of the main body, respectively;

a latch member turnably fitted onto one of the shafts;

a pair of engagement pins fixedly disposed in the bill stacker at positions corresponding to positions of the shafts in the main body; and a spring member for biasing the latch member in a predetermined direction.

4. The bill processor as claimed in claim 3, wherein the spring member is in the form of a leaf spring, and the leaf spring and the main body are integrally formed by molding an elastic material such as synthetic resin.

5. The bill processor as claimed in claim 1, further comprising a front cover for covering a front surface of the main body, the front cover being formed with the bill inserting slit and having liquid collecting/draining means for collecting and draining liquid which flows into the main body through the bill inserting slit.

* * * * *